US006817060B2

(12) United States Patent
Huang et al.

(10) Patent No.: US 6,817,060 B2
(45) Date of Patent: Nov. 16, 2004

(54) COLLAPSIBLE HANDLE DEVICE FOR INFLATOR

(76) Inventors: Chun-Ming Huang, No. 111, Tseng-Fu Lane, Tseng-Tso Vill., Hsiu-Shui Hsiang, Chang-Hua Hsien (TW); Ying-Che Huang, No. 111, Tseng-Fu Lane, Tseng-Tso Vill., Hsiu-Shui Hsiang, Chang-Hua Hsien (TW)

( * ) Notice: Subject to any disclaimer, the term of this patent is extended or adjusted under 35 U.S.C. 154(b) by 8 days.

(21) Appl. No.: 10/350,346

(22) Filed: Jan. 22, 2003

(65) Prior Publication Data

US 2004/0139576 A1 Jul. 22, 2004

(51) Int. Cl.[7] ..... B65D 25/28; F04B 53/00
(52) U.S. Cl. ..... 16/111.1; 417/234; 417/553
(58) Field of Search ..... 16/111.1, 408–411; 417/468–469, 234–235; D23/231

(56) References Cited

U.S. PATENT DOCUMENTS 2,462,980 A * 3/1949 Litt ..... 16/110.1
3,819,302 A * 6/1974 Ohashi ..... 417/234
5,347,913 A * 9/1994 Stepner ..... 417/234
5,494,411 A * 2/1996 Chuang ..... 417/234
D386,245 S * 11/1997 Downs et al. ..... D23/231
6,017,196 A * 1/2000 Wu ..... 417/234

* cited by examiner

*Primary Examiner*—John B. Walsh
*Assistant Examiner*—Christopher Boswell

(57) ABSTRACT

A collapsible handle device for an inflator comprises an air cylinder having a shaft lever and a hollow grip, in which one end of the shaft lever is connected to a piston inside the air cylinder, and the other end is provided with a rotation body, which is pivotally jointed with the grip. A channel, wider than the diameter of the shaft lever, is formed in the lateral wall of the grip. The air cylinder could be inserted in the grip so as to reduce the volume of the inflator, or the air cylinder could be pulled out from the grip, then turned 180° to form a straight line with the shaft lever so that a user may hold the air cylinder with one hand and operate the shaft lever in axial direction to pump air out through an air vent at one end of the air cylinder.

2 Claims, 5 Drawing Sheets

COLLAPSIBLE HANDLE DEVICE FOR INFLATOR

FIELD OF THE INVENTION

This invention relates to a collapsible handle device applicable, for example, to a bicycle.

BACKGROUND OF THE INVENTION

A generic inflator having a collapsible handle device available in the market is made for easy packing in a small volume to thus facilitate storing or carrying when it is not in use, or extending it for hand operation if desired.

Referring to a conventional inflator having a collapsible handle device shown in FIG. 5, one end of a shaft lever (B) of an air cylinder (A) is pivotally jointed to a grip (D) through a shaft pin (C). In a lateral wall of the grip (D), a channel (D1) having its width larger than the shaft lever (B)'s diameter and penetrating only one end of the grip (D) is formed. When the inflator is not in use, a user may turn the grip (D) relatively to the shaft lever (B) to permit the latter to go passing the channel (D1) for being stored inside the grip (D). And further, the user may also make the grip (D) and the air cylinder (A) stand in a straight line such that he can store or carry the inflator by this way, or he may grasp the grip and move it axially so that the piston in the air cylinder (A) would pump the inside air out. However, the operation in this way can merely squeeze an insufficient quantity of air into a bicycle's tire due to the shortened stroke of the shaft lever (B) and accordingly the reduced volume inside the air cylinder caused by the limitation of the bottom end (D2) of the grip (D). Therefore, a user is likely to draw the shaft lever (B) and grip (D) out and bend the grip (D) perpendicularly to form an L character with the shaft lever (B) to remove the limitation on the shaft lever (B)'s stroke to hence make full use of the volume of the air cylinder. Nevertheless, the L-shape operation is rather tough because of the application of a force moment involved.

SUMMARY OF THE INVENTION

The primary objective of this invention is to eliminate the drawback that the volume efficiency of a conventional collapsible handle device for an inflator is reduced when a grip and an air cylinder are aligned in a straight line.

Another objective of this invention is to eliminate the drawback that the operability of a conventional collapsible handle device for an inflator is deteriorated when a grip is extended to form an L-character with a shaft lever.

Yet another objective of this invention is to eliminate the drawback that the volume of a conventional collapsible handle device for an inflator is not minimized when a grip thereof is collapsed.

In order to realize abovesaid objectives, the collapsible handle device for the inflator of this invention is accomplished by forming a channel penetrating both ends of a grip in a lateral wall thereof; and pivotally jointing a rotation body at one end of a shaft lever with one end of the grip so that an air cylinder could be inserted in the grip through one end thereof for reducing the volume of the entire inflator. Also the air cylinder could be drawn out of the grip, and then turned 180° to form a straight line with the shaft lever to thereby enable a user to hold the air cylinder with one band and operate the shaft lever axially with the other so that air is pumped out through an air vent without reducing the volume efficiency of the air cylinder.

In addition, an annular flange and a corresponding annular groove is formed on the air cylinder and the grip, respectively, to serve as a sleeve-jointing structure for better positioning the air cylinder in the grip.

When compared with a conventional collapsible handle device for an inflator, this invention shall not reduce the volume efficiency when the grip and the shaft lever are extended to stand in a straight line for inflating operation, and furthermore it is much easier to operate, and reducible to a minimum volume for easy carrying and storing.

For more detailed information regarding advantages or features of this invention, at least an example of preferred embodiment will be fully described below with reference to the annexed drawings.

BRIEF DESCRIPTION OF THE DRAWINGS

The related drawings in connection with the detailed description of this invention to be made later are described briefly as follows, in which.

DETAILED DESCRIPTION OF THE INVENTION

Figure 1:
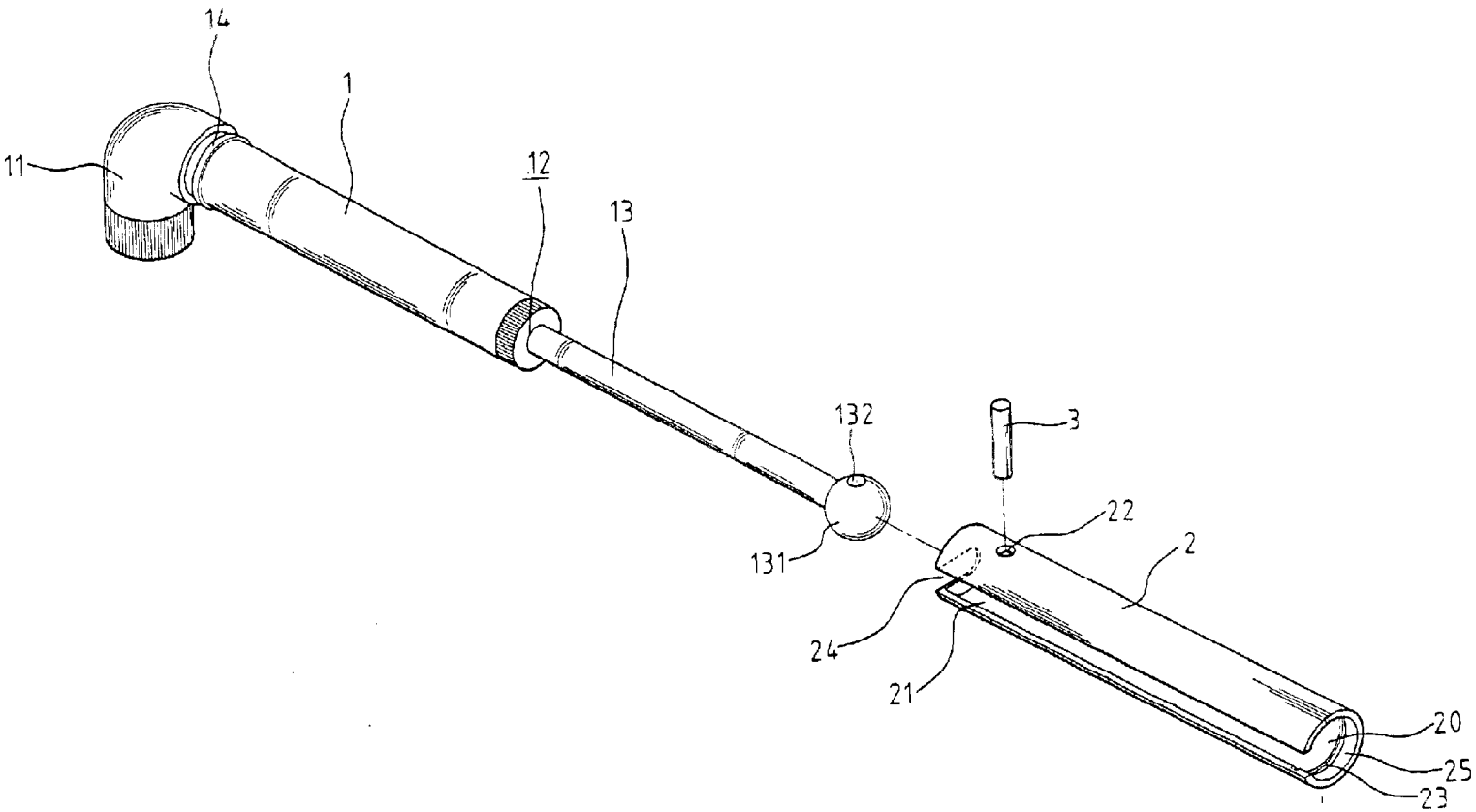
FIG. 1 is a three-dimensional view showing the structure of an air cylinder and grip of this invention and a separate state thereof.

As illustrated in FIG. 1, an embodiment of this invention comprises an air cylinder 1 and a hollow tubular grip 2, in which a piston (not shown) is buried in the air cylinder 1 and connected with a shaft lever 13 in a way such that one end of the shaft lever 13 can penetrate a through hole 12 formed in one end of the air cylinder 1. The end of the shaft lever 13 penetrated through air cylinder is provided with a rotation body 131 having a through hole 132 on two respective sides. The rotation body 131 is preferably a sphere for mating with the inner diameter of the tubular grip 2. An air vent 11 is arranged in the other end of the air cylinder 1 for rejecting the air in the air cylinder 1 as the piston is driven to move when the shaft lever 13 is moving axially.

The mentioned grip 2, about the same as the air cylinder 1 in length, is substantially a hollow tubular body having a channel mouth 24 and an opening 25 defined at its respective ends (the channel mouth 24 is U-shaped in this invention). A channel 21 is formed in the lateral wall of the grip 2 from the channel mouth 24 to go along the central axial direction all the way down to the opening 25, in which both the width of the channel 21 and the channel mouth 24 are larger than the diameter of the shaft lever 13. A hole 22 penetrating the lateral wall of the grip 2 twice is defined adjacent to the channel mouth 24, and an inner space 20 of the grip 2 is available for receiving the air cylinder 1. The mentioned rotation body 131 combined with the shaft lever 13 is inserted in the inner space of the grip 2 through the opening 25 to have its hole 132 aligned with the hole 22 so that a shaft pin 3 can pass through the hole 22 of the grip 2 twice and the hole 132 of the rotation body 131 and pivotally joint the grip 2 and the shaft lever 13.

Figure 3:
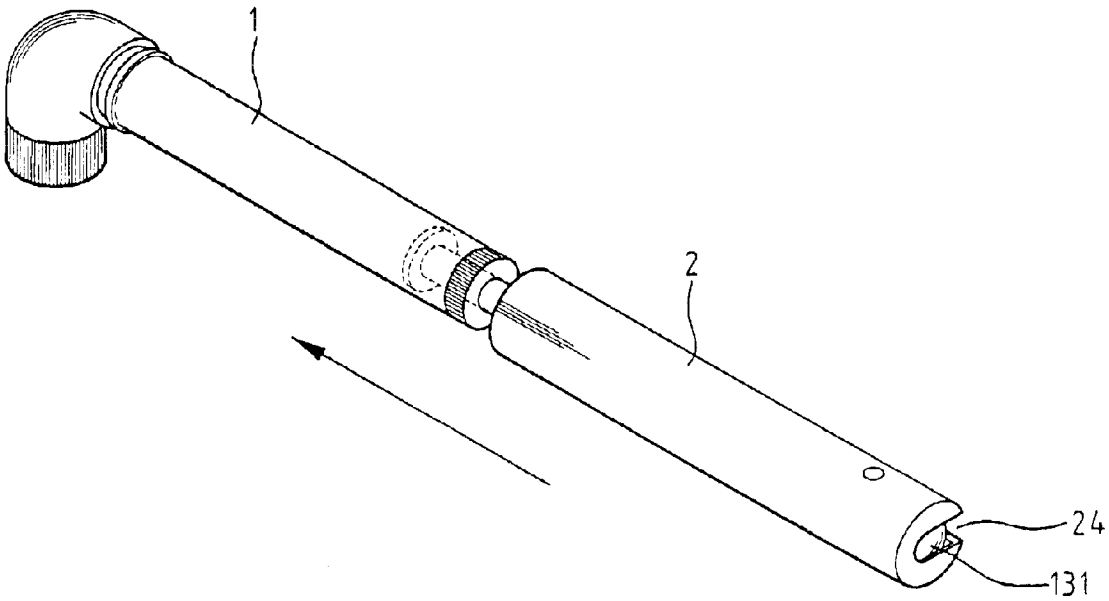
FIG. 3 is a three-dimensional view showing that the grip is turned around such that the shaft lever can be hidden in the grip.
Figure 4:
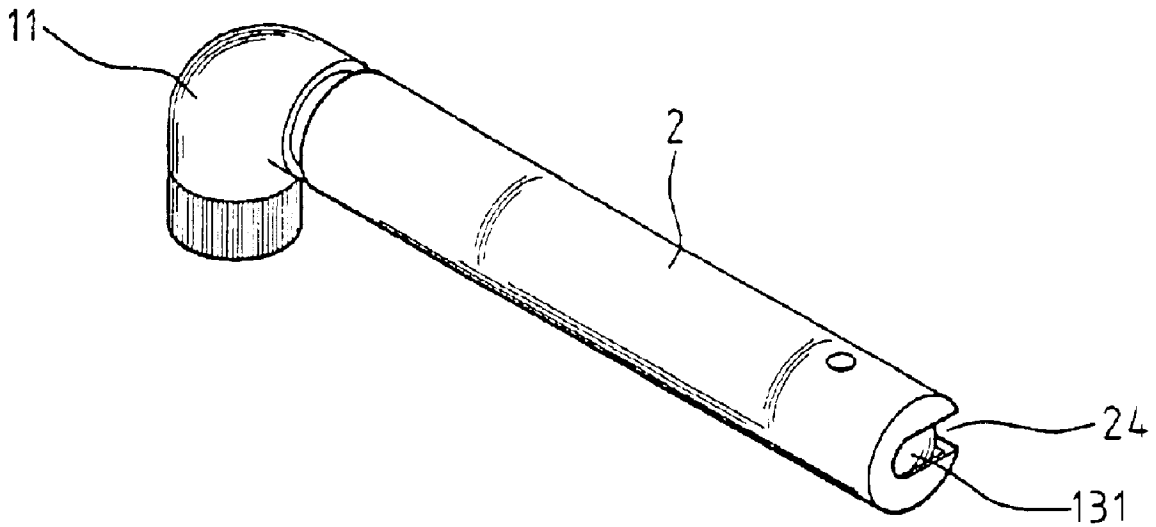
FIG. 4 is a three-dimensional view showing the state of pushing the air cylinder into the grip.
Figure 5:
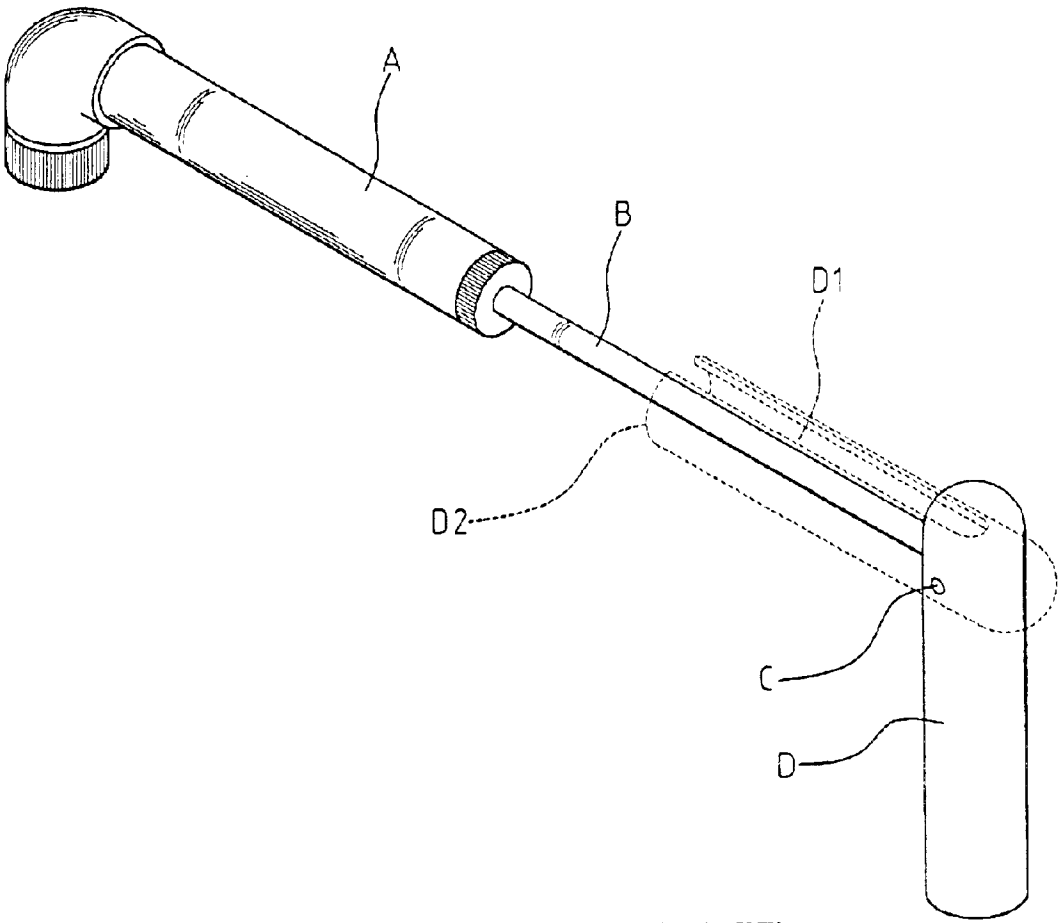
FIG. 5 (PRIOR ART)
FIG. 5 is a three-dimensional view showing the structure of a convenient collapsible inflator.

When the inflator is not in use, a user may turn the grip 2 relatively to the air cylinder 1 to a position, where the opening 25 would point toward the air cylinder 1 as shown in FIG. 3. The air cylinder 1 can be pushed into the inner space 20 of the grip 2 through the opening 25 for being stored in the grip 2 as shown in FIG. 4. With the air cylinder 1 stored inside the and grip 2, the whole body of the inflator can be reduced to a minimum volume for easy carrying or storing.

Figure 2:
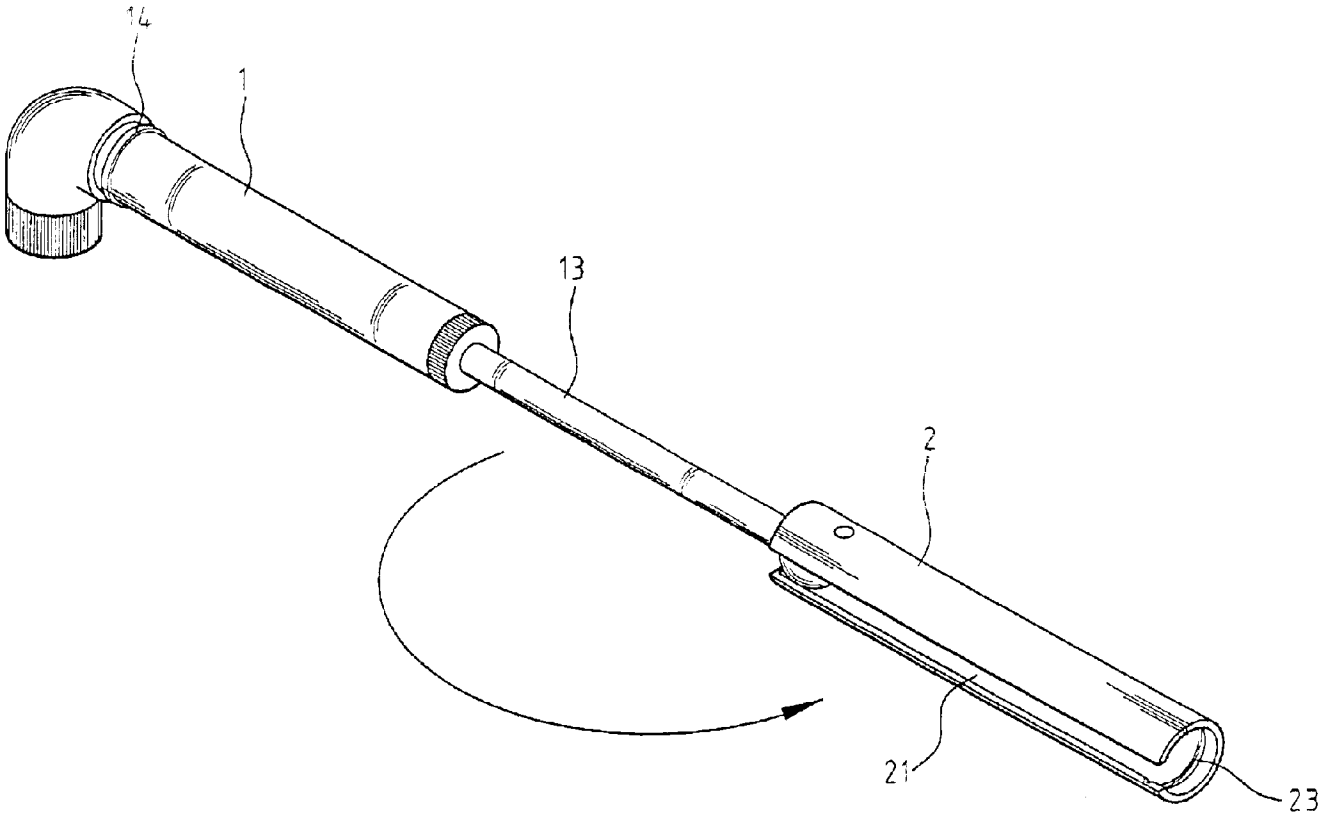
FIG. 2 is a three-dimensional view showing the state that a rotation body buried in a shaft lever of this invention is pivotally jointed to the grip.

When the use of the inflator is desired, a user is supposed to draw the air cylinder 1 out of the grip 2 (as in the state that FIG. 3 indicates), then, turn the grip 2 to allow the shaft lever 13 to move out of the channel 21, and turn the grip 2 farther until 180° is reached to permit the shaft lever 13 to enter the channel mouth 24 for being fixed in the shaft lever 2 stably (as the state shown in FIG. 2). After the procedures are done, the shaft lever 13 is prolonged and both the grip 2 and the shaft lever 13 are flush aligned. Under such a situation, the user is capable of holding the air cylinder 1 with one hand and holding the grip 2 with the other for operating the shaft lever 13 in axial direction for inflating.

Besides, for better positioning after the air cylinder 1 enters the grip 2, an annular flange 14 is defined on the outer wall of the air cylinder 1 while a corresponding annular groove 23 is formed on the inner wall of the grip 2 so that the annular flange 14 is flexibly forced into the annular groove 23 for being positioned. In the embodiment of this invention, the annular flange 14 is disposed adjacent to the air vent 11 while the annular groove 23 is adjacent to the opening 25 to hence obtain a good engagement and positioning of the grip 2 and the air cylinder 1.

In the above described, at least one preferred embodiment has been described in detail with reference to the drawings annexed, and it is apparent that numerous changes or modifications may be made without departing from the true spirit and scope thereof, as set forth in the claims below.

What is claimed is:

1. A collapsible handle device for an inflator, comprising:

a shaft lever having a first end connected with a piston and a second end connected with a rotation body, said rotation body having a through hole;

an air cylinder having a first end connected to an air vent and a second end receiving said first end of said shaft lever, said piston being movably disposed in said air cylinder; and a tubular grip having a first end formed with a channel mouth, an open second end, and an open channel extending from said channel mouth to said open second end, said tubular grip being pivotally connected to said rotation body by a shaft pin passing through said through hole of said rotation body and two pin holes formed near said first end of said tubular grip, and said tubular grip enclosing said shaft lever when said open second end of said tubular grip is folded towards said second end of said air cylinder;

wherein said tubular grip has an inner diameter larger than an outer diameter of said air cylinder, and said air cylinder is receivable within said tubular grip through said second open end and substantially embedded in said tubular grip when said shaft lever is enclosed in said tubular grip and pushed towards said air vent.

2. The collapsible handle device according to claim 1, wherein said air cylinder further has an outer annular flange formed near said air vent for engaging with a corresponding inner annular groove formed near said second open end of said tubular grip.

* * * * *